US005378570A

United States Patent [19]

Kobayashi et al.

[11] Patent Number: 5,378,570

[45] Date of Patent: Jan. 3, 1995

[54] ELECTROPHOTOGRAPHIC PHOTORECEPTOR

[75] Inventors: Tomoo Kobayashi; Katsuhiro Sato, both of Minami ashigara, Japan

[73] Assignee: Fuji Xerox Co., Ltd., Tokyo, Japan

[21] Appl. No.: 175,224

[22] Filed: Dec. 29, 1993

[30] Foreign Application Priority Data

Jan. 5, 1993 [JP] Japan ..... 5-015920
Jan. 14, 1993 [JP] Japan ..... 5-020811

[51] Int. Cl.[6] ..... G03G 5/05

[52] U.S. Cl. ..... 430/58; 430/56; 430/96

[58] Field of Search ..... 430/96, 58, 56

[56] References Cited

U.S. PATENT DOCUMENTS 2,297,691 10/1942 Carlson .
3,491,060 1/1970 Schminke et al. .
5,202,408 4/1993 Yanus et al. ..... 430/96
5,316,880 5/1994 Pai et al. ..... 430/59

FOREIGN PATENT DOCUMENTS 62-247374 10/1987 Japan .
63-148263 6/1988 Japan .
1-269942 10/1989 Japan .
2-254459 10/1990 Japan .
3-273256 1/1991 Japan ..... 430/96
3-63651 3/1991 Japan .
1218447 10/1968 United Kingdom .

OTHER PUBLICATIONS

Joachim Kohn and Robert Langen, "Poly(iminocarbonates) as potential biomaterials", *Biomaterials*, May 1986, vol. 7, pp. 176–182.

Chun Li and Joachim Kohn, "Macromolecules" *American Chemistry Society*, vol. 22, No. 5, May 1989, pp. 176–182.

Satish Pulapura et al., "Structure–property relationships for the design of polyiminocarbonates", *Biomaterials*, Nov. 1990, vol. 11, pp. 666–678.

M. Bauer et al., "Networks from Dicyanate of Bishpenol and Diphenols", *Makromol. Chem., Macromol. Symp.*, vol. 45, (1991), pp. 97–103.

*Primary Examiner*—Christopher D. Rodee
*Attorney, Agent, or Firm*—Oliff & Berridge

[57] ABSTRACT

An electrophotographic photoreceptor comprising a conductive substrate having formed thereon a photosensitive layer is disclosed, wherein said photosensitive layer contains, as a binder resin, a polyiminocarbonate resin comprising at least one of recurring units represented by formulae (I), (II) and (III):

(I)

(II)

(III)

wherein the symbols are as defined in the specification. The polyiminocarbonate resin exhibits satisfactory solvent solubility and high compatibility with a charge transporting material and a charge generating material to provide a coating composition having satisfactory stability with time and a uniform coating film. The photoreceptor therefore has excellent electrophotographic characteristics and satisfactory productivity.

8 Claims, No Drawings

ELECTROPHOTOGRAPHIC PHOTORECEPTOR

FIELD OF THE INVENTION

This invention relates to an electrophotographic photoreceptor and more particularly to an electrophotographic photoreceptor containing a specific polyiminocarbonate resin as a binder resin, which photoreceptor can be produced with satisfactory productivity and exhibits excellent electrophotographic characteristics.

BACKGROUND OF THE INVENTION

Electrophotography has been broadening its application in the field of copying machines, laser beam printers, etc. because of the advantages of high speed and high image quality.

A Carlson image formation system disclosed in U.S. Pat. No. 2,297,691 has generally been adopted in the current electrophotography using an electrophotographic photoreceptor. An electrophotographic photoreceptor used according to this technique repeatedly undergoes electrical and mechanical outer force through processes of charging, exposure, development, transfer, cleaning, destaticizing, and the like. In this situation, electrophotographic photoreceptors comprising inorganic photoconductive materials, such as selenium, selenium-tellurium alloys, and selenium-arsenic alloys, have conventionally been employed. On the other hand, photoreceptors comprising organic photoconductive materials have also been studied with attention being paid on their merits over inorganic photoreceptors, such as cheapness, productivity, and ease of disposal. In particular, organic photoreceptors of separate function type having a laminate structure composed of a charge generating layer which functions to generate charge on exposure to light and a charge transporting layer which functions to transport the generated charge are excellent in electrophotographic characteristics, such as sensitivity, charging properties, and stability of these properties on repeated use. Various proposals on this type of photoreceptors have been made to date, and some of them have been put to practical use.

While organic laminate type photoreceptors which have hitherto been developed are satisfactory in terms of the above-mentioned electrophotographic characteristics, there still remains an unsolved problem of durability against mechanical outer force in nature of the organic materials used. That is, being made of an organic material, a photosensitive layer tends to undergo wear or scratches on contact with a toner, a developer, a transfer medium (e.g., paper), a cleaning member, and the like and to suffer from adhesion of foreign substances such as toner filming, and the like, resulting in development of image defects. The working life of an organic photoreceptor has thus been limited.

Besides, with the recent advancement in color image formation and high-speed recording with copying machines and printers, the process involved has been getting more complicated, and the stress imposed on a photoreceptor has been increasing. From this viewpoint, too, the demand for improved sensitivity and durability of an electrophotographic photoreceptor has been increasing.

A number of measures have ever been proposed to improve durability of an electrophotographic photoreceptor. For example, various polycarbonate resins have been suggested as a binder resin for the surface layer of a photoreceptor (see JP-A-62-247374, JP-A-63-148263, JP-A-2-269942, JP-A-2-254459, and JP-A-3-63651; the term "JP-A" as used herein means an "unexamined published Japanese patent application").

Use of the known polycarbonate binder resins somewhat achieved improvement on durability, but the state-of-the-art photoreceptors are still unsatisfactory. That is, these resins have their several merits and demerits. For example, the most prevalent polycarbonate resin is soluble only in specific halogenated aliphatic hydrocarbons having a low boiling point. A coating composition prepared by using such a solvent causes whitening or orange peel of the coated surface. Further, since the solvent easily volatilizes before coating, the solid concentration of the coating composition increases to cause precipitation of the resin or additives, resulting in poor production yield. A coating composition if prepared by using other solvents undergoes gelation in a few days due to the low solubility, also resulting in poor production yield. Even in using polycarbonate resins having satisfactory solvent solubility, they have insufficient compatibility with a charge transporting material so that a coating composition containing a sufficient amount of a charge transporting material for obtaining desired electrophotographic characteristics tends to undergo precipitation of the charge transporting material.

Further, since many polycarbonate resins exhibit poor compatibility with a charge generating material, a charge generating material when dispersed with these polycarbonate resins is agglomerated, failing to provide a uniform coating film and to secure excellent image quality.

SUMMARY OF THE INVENTION

An object of the present invention is to provide an electrophotographic photoreceptor having excellent electrophotographic characteristics and satisfactory productivity which is prepared by using a specific binder resin exhibiting satisfactory solvent solubility to provide a coating composition free from solidification or gelation, that is, with satisfactory stability with time and also exhibiting high compatibility with a charge transporting material and a charge generating material to provide a uniform coating film.

As a result of extensive investigations on various binder resins for a photosensitive layer, the present inventors have found that the above object of the present invention is accomplished by using a specific polyiminocarbonate resin as a binder resin and thus completed the present invention.

The present invention provides an electrophotographic photoreceptor comprising a conductive substrate having formed thereon a photosensitive layer, wherein said photosensitive layer contains, as a binder resin, a polyiminocarbonate resin comprising at least one of a recurring unit represented by formula (I):

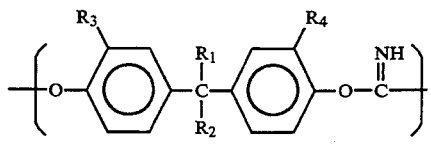

(I)

wherein $R_1$ and $R_2$ each represent a hydrogen atom, an alkyl group, an aryl group, an aralkyl group or an alicyclic group, or $R_1$ and $R_2$ are taken together to form a carbonaceous ring or a lactone ring; and $R_3$ and $R_4$ each represent a hydrogen atom, a halogen atom, an alkyl group, an alkoxy group, an aryl group or a cycloalkyl group, a recurring unit represented by formula (II):

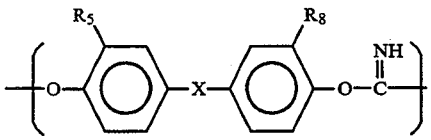

(II)

wherein X represents —S—, —O—, —$SO_2$— or —CO—; and $R_5$ and $R_6$ each represent a hydrogen atom, a halogen atom, an alkyl group, an aryl group, an alkoxy group or a cycloalkyl group, and a recurring unit represented by formula (III):

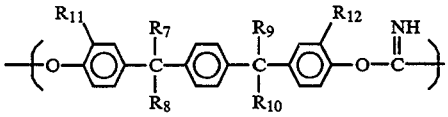

(III)

wherein $R_7$, $R_8$, $R_9$, and $R_{10}$ each represent a hydrogen atom, an alkyl group, a cycloalkyl group, an aryl group or an aralkyl group; and $R_{11}$ and $R_{12}$ each represent a hydrogen atom, a halogen atom, an alkyl group, an alkoxy group, a cycloalkyl group or an aryl group.

DETAILED DESCRIPTION OF THE INVENTION

The electrophotographic photoreceptor according to the present invention comprises a conductive substrate having thereon at least a photosensitive layer.

The conductive substrate which can be used in the present invention includes metals, e.g., aluminum, nickel, chromium, stainless steel, etc.; plastic films having a conductive thin film of aluminum, titanium, nickel, chromium, stainless steel, gold, vanadium, tin oxide, indium oxide or indium-tin oxide (ITO); and paper or plastic films coated or impregnated with a conductivity-imparting material. While not limiting, these substrate materials are usually used in a drum form, a sheet form or a plate form. If desired, the conductive substrate may be subjected to various surface treatments as far as image quality is not impaired. Suitable surface treatments include oxidation, chemical treatments, coloring, and treatments for irregular reflection, such as surface graining.

If desired, a subbing layer may be provided between a conductive substrate and a photosensitive layer. A subbing layer functions to block injection of charge from a conductive substrate to a photosensitive layer at the time of charging and also serves as an adhesive layer between a conductive substrate and a photosensitive layer. In some cases, a subbing layer functions to prevent reflection of light on a conductive substrate.

A subbing layer can be formed by using known binder resins. Suitable materials to be used in a subbing layer include known binder resins, such as polyamide resins, vinyl chloride resins, vinyl acetate resins, phenolic resins, polyurethane resins, melamine resins, benzoguanamine resins, polyimide resins, polyethylene resins, polypropylene resins, polycarbonate resins, acrylic resins, methacrylic resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acid, starch, starch acetate, amino starch, polyacrylic acid, and polyacrylamide; and other known materials, such as organotitanium compounds, e.g., titanyl chelate compounds and titanium alkoxides, zirconium chelate compounds, and silane coupling agents. These materials may be used either individually or in combination of two or more thereof. In addition, fine particle of titanium oxide, aluminum oxide, silicon oxide, zirconium oxide, barium titanate, a silicone resin, etc. may be incorporated into a subbing layer.

A coating composition for a subbing layer is coated on a conductive substrate by a generally employed coating technique, such as blade coating, wire bar coating, spray coating, dip coating, bead coating, air knife coating, and curtain coating to a dry thickness of from 0.01 to 10 μm, and preferably from 0.05 to 2 μm.

A photosensitive layer formed on a conductive substrate may have either a single layer structure or a separate function type laminate structure composed of a charge generating layer and a charge transporting layer, with the latter structure being preferred. In the latter case, the order of the charge generating layer and the charge transporting layer is not limited.

The photosensitive layer, either single-layered or multi-layered, contains a polyiminocarbonate resin having at least one of recurring units of formulae (I), (II) and (III) as a binder resin. It is preferable that the polyimino-carbonate resin of the present invention be present in an uppermost layer of the photosensitive layer having the separate function type laminate structure.

Specific examples of the recurring units of formulae (I), (II) and (III) are shown below.

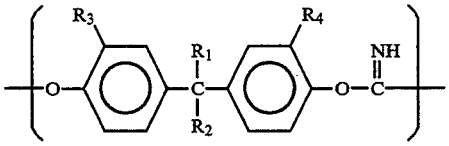

(I)

| Unit No. | $R_1$ | $R_2$ | $R_3$ | $R_4$ |
|---|---|---|---|---|
| I-1 | H | H | H | H |
| I-2 | H | H | $CH_3$ | $CH_3$ |
| I-3 | H | H | 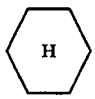 | 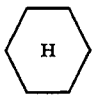 |
| I-4 | H | $CH_3$ | H | H |

-continued

| | | | | |
|---|---|---|---|---|
| I-5 | H | $CH_3$ | $CH_3$ | $CH_3$ |
| I-6 | H | $C_2H_5$ | $CH_3$ | $CH_3$ |
| I-7 | H | n-$C_3H_7$ | H | H |
| I-8 | H | i-$C_4H_9$ | H | H |
| I-9 | H | t-$C_4H_9$ | H | H |
| I-10 | H | t-$C_4H_9$ | $CH_3$ | $CH_3$ |
| I-11 | H | t-$C_4H_9$ | t-$C_4H_9$ | t-$C_4H_9$ |
| I-12 | H | 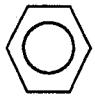 | H | H |
| I-13 | H | 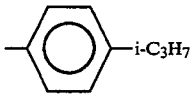  | H | H |
| I-14 | | 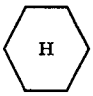  | H | H |
| I-15 | | 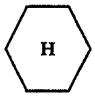  | $CH_3$ | $CH_3$ |
| I-16 | H | 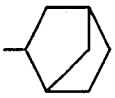 | H | H |
| I-17 | H | 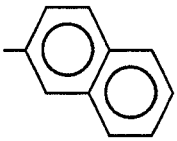 | H | H |
| I-18 | H | $(CH_2)_9CH_3$ | H | H |
| I-19 | H | $(CH_2)_{10}CH_3$ | H | H |
| I-20 | H | $(CH_2)_{12}CH_3$ | H | H |
| I-21 | H | $(CH_2)_{16}CH_3$ | H | H |
| I-22 | H | $(CH_2)_{20}CH_3$ | H | H |
| I-23 | $CH_3$ | $CH_3$ | H | H |
| I-24 | $CH_3$ | $CH_3$ | $CH_3$ | $CH_3$ |
| I-25 | $CH_3$ | $CH_3$ | $C_2H_5$ | $C_2H_5$ |
| I-26 | $CH_3$ | $CH_3$ | i-$C_3H_7$ | i-$C_3H_7$ |
| I-27 | $CH_3$ | $CH_3$ | n-$C_3H_7$ | n-$C_3H_7$ |
| I-28 | $CH_3$ | $CH_3$ | i-$C_4H_9$ | i-$C_4H_9$ |
| I-29 | $CH_3$ | $CH_3$ | t-$C_4H_9$ | t-$C_4H_9$ |
| I-30 | $CH_3$ | $CH_3$ | n-$C_4H_9$ | n-$C_4H_9$ |
| I-31 | $CH_3$ | $CH_3$ | s-$C_4H_9$ | s-$C_4H_9$ |
| I-32 | $CH_3$ | $CH_3$ | 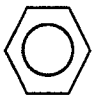 | 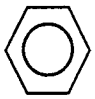 |
| I-33 | $CH_3$ | $CH_3$ | 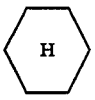  | 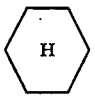  |
| I-34 | $CH_3$ | $CH_3$ | F | F |
| I-35 | $CH_3$ | $CH_3$ | Cl | Cl |
| I-36 | $CH_3$ | $CH_3$ | Br | Br |
| I-37 | $CH_3$ | $C_2H_5$ | H | H |
| I-38 | $CH_3$ | $C_2H_5$ | $CH_3$ | $CH_3$ |
| I-39 | $CH_3$ | $C_2H_5$ | Cl | Cl |
| I-40 | $CH_3$ | n-$C_3H_7$ | H | H |
| I-41 | $CH_3$ | n-$C_3H_7$ | $CH_3$ | $CH_3$ |
| I-42 | $CH_3$ | i-$C_4H_9$ | H | H |

-continued
| | | | | |
|---|---|---|---|---|
| I-43 | $CH_3$ | i-$C_4H_9$ | Cl | Cl |
| I-44 | $CH_3$ | i-$C_4H_9$ | $OCH_3$ | $OCH_3$ |
| I-45 | $CH_3$ | $(CH_2)_4CH_3$ | $CH_3$ | $CH_3$ |
| I-46 | $CH_3$ | $(CH_2)_8CH_3$ | H | H |
| I-47 | $CH_3$ | 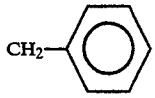 | H | H |
| I-48 | $CH_3$ | 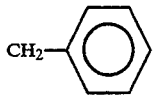 | $CH_3$ | $CH_3$ |
| I-49 | $CH_3$ | 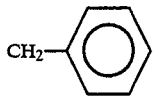 | Cl | Cl |
| I-50 | $CH_3$ | 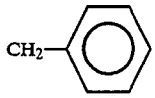 | Br | Br |
| I-51 | $CH_3$ | 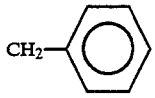 | H | H |
| I-52 | $CH_3$ | 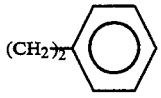 | $CH_3$ | $CH_3$ |
| I-53 | $CH_3$ | 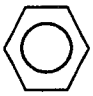 | H | H |
| I-54 | $CH_3$ | 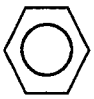 | $CH_3$ | $CH_3$ |
| I-55 | $CH_3$ | 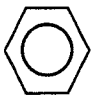 | t-$C_4H_9$ | t-$C_4H_9$ |
| I-56 | $CH_3$ | 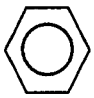 | Cl | Cl |
| I-57 | $CH_3$ | 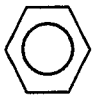 | 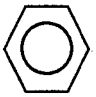 | 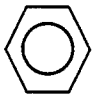 |
| I-58 | $CH_3$ | 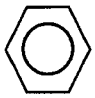 | 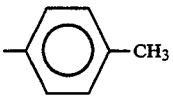 | 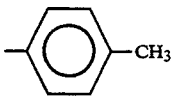 |
| I-59 | $CH_3$ | 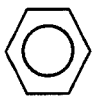 | 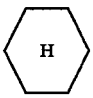 | 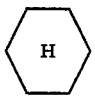 |

-continued
| | | | | |
|---|---|---|---|---|
| I-60 | | 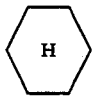 | 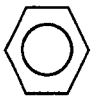 | 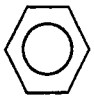 |
| I-61 | $C_2H_5$ | $C_2H_5$ | H | H |
| I-62 | $C_2H_5$ | $C_2H_5$ | $CH_3$ | $CH_3$ |
| I-63 | $C_2H_5$ | $C_2H_5$ | Cl | Cl |
| I-64 | $C_2H_5$ | $C_2H_5$ | 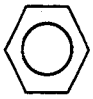 | 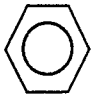 |
| I-65 | $C_2H_5$ | $C_2H_5$ | 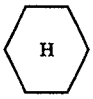 | 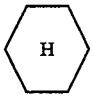 |
| I-66 | $C_2H_5$ | 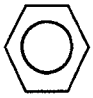 | H | H |
| I-67 | $C_2H_5$ | 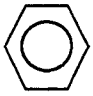 | $CH_3$ | $CH_3$ |
| I-68 | n-$C_3H_7$ | n-$C_3H_7$ | H | H |
| I-69 | n-$C_3H_7$ | n-$C_3H_7$ | $CH_3$ | $CH_3$ |
| I-70 | n-$C_4H_9$ | n-$C_4H_9$ | H | H |
| I-71 | n-$C_4H_9$ | n-$C_4H_9$ | $CH_3$ | $CH_3$ |
| I-72 | 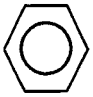 | 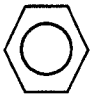 | H | H |
| I-73 | 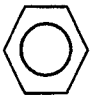 | 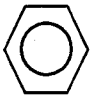 | $CH_3$ | $CH_3$ |
| I-74 | 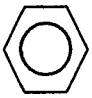 | 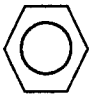 | Cl | Cl |
| I-75 | 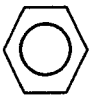 | 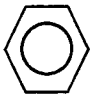 | Br | Br |
| I-76 | 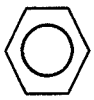 | 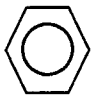 | 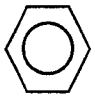 | 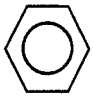 |
| I-77 | 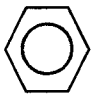 | 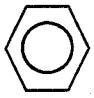 | 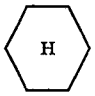 | 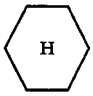 |
| I-78 | 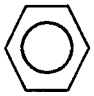 | 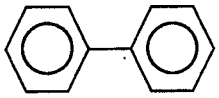 | H | H |

-continued
| | | | | |
|---|---|---|---|---|
| I-79 | 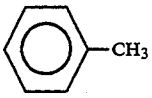 | 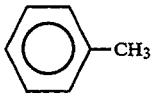 | H | H |
| I-80 | 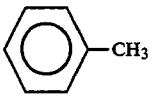 | 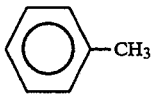 | $CH_3$ | $CH_3$ |
| I-81 | 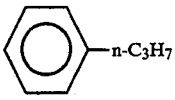 | 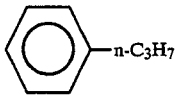 | $CH_3$ | $CH_3$ |
| I-82 | 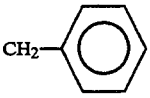 | 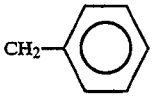 | H | H |
| I-83 | 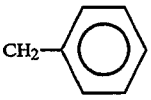 | 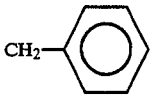 | $CH_3$ | $CH_3$ |
| I-84 | 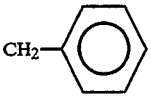 | 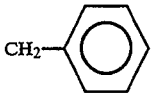 | 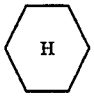 | 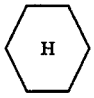 |
| 1-85 | 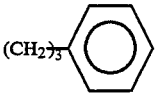 | 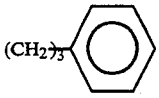 | H | H |
| I-86 | 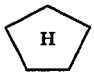 | | H | H |
| I-87 | 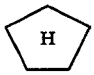 | | $CH_3$ | $CH_3$ |
| I-88 | 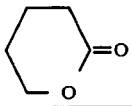 | | H | H |
(II)
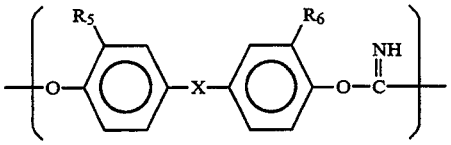
| Unit No. | X | $R_5$ | $R_6$ |
|---|---|---|---|
| II-1 | O | H | H |
| II-2 | S | H | H |
| II-3 | S | $CH_3$ | $CH_3$ |
| II-4 | S | t-$C_4H_9$ | t-$C_4H_9$ |
| II-5 | $SO_2$ | H | H |
| II-6 | $SO_2$ | $CH_3$ | $CH_3$ |
| II-7 | $SO_2$ | 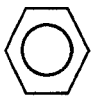 | 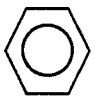 |

-continued
| | | | |
|---|---|---|---|
| II-8 | $SO_2$ | 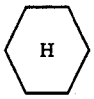 | 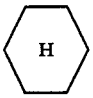 |
| II-9 | CO | H | H |
| II-10 | CO | $CH_3$ | $CH_3$ |
(III)
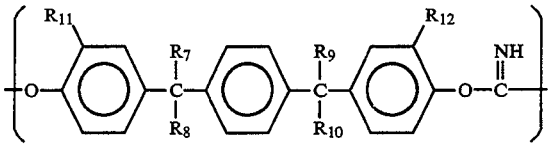
| Unit No. | $R_7$, $R_9$ | $R_8$, $R_{10}$ | $R_{11}$ $R_{12}$ |
|---|---|---|---|
| III-1 | H | $CH_3$ | H |
| III-2 | H | $CH_3$ | $CH_3$ |
| III-3 | H | 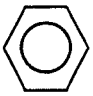 | H |
| III-4 | $CH_3$ | $CH_3$ | H |
| III-5 | $CH_3$ | $CH_3$ | $CH_3$ |
| III-6 | $CH_3$ | $CH_3$ | i-$C_3H_7$ |
| III-7 | $CH_3$ | $CH_3$ | 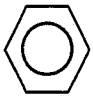 |
| III-8 | $CH_3$ | 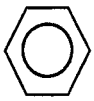 | H |
| III-9 | $CH_3$ | 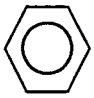 | $CH_3$ |
| III-10 | $CH_3$ | 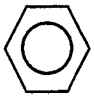 | i-$C_3H_7$ |
| III-11 | $CH_3$ | 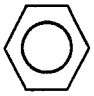 | t-$C_4H_9$ |
| III-12 | $CH_3$ | 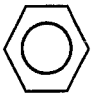 | 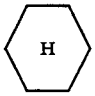 |
| III-13 | $CH_3$ | 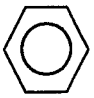 | 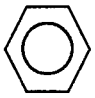 |
| III-14 | $CH_3$ | 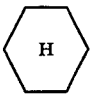 | H |

-continued

| | | | |
|---|---|---|---|
| III-15 | $CH_3$ | $CH_2$— | H |
| III-16 | $CH_3$ | $CH_2$— | $CH_3$ |
| III-17 | | | H |
| III-18 | | | $CH_3$ |
| III-19 | | | t-$C_4H_9$ |
| III-20 | | | |
| III-21 | | H | H |
| III-22 | | $CH_2$— | H |
| III-23 | | $CH_2$— | $CH_3$ |

While in the specific examples of recurring units given above $R_3$ and $R_4$ in formula (I), $R_5$ and $R_6$ in formula (II), and $R_7$ and $R_9$, or $R_8$ and $R_{10}$, or $R_{11}$ and $R_{12}$ in formula (III) happen to be the same, they may be different from each other.

The polyiminocarbonate resins according to the present invention include not only homopolymers having only one of the above-mentioned recurring units but copolymers having any combination of two or more of them, e.g., copolymers comprising a recurring unit of formula (I) and a recurring unit of formula (II) or (III) and copolymers comprising a recurring unit of formula (II) and a recurring unit of formula (III).

Illustrative examples of copolymers comprising a recurring unit of formula (I) and a recurring unit of formula (II) are shown below.

| Copolymer No. | Unit A of Formula (I) | Unit B of Formula (II) | A:B Molar Ratio |
|---|---|---|---|
| I-II-1 | I-14 | II-1 | 50:50 |
| I-II-2 | I-14 | II-2 | 50:50 |
| I-II-3 | I-14 | II-5 | 50:50 |

-continued

| Copolymer No. | Unit A of Formula (I) | Unit B of Formula (II) | A:B Molar Ratio |
|---|---|---|---|
| I-II-4 | I-15 | II-1 | 50:50 |
| I-II-5 | I-15 | II-2 | 50:50 |
| I-II-6 | I-23 | II-1 | 50:50 |
| I-II-7 | I-23 | II-1 | 70:30 |
| I-II-8 | I-23 | II-2 | 50:50 |
| I-II-9 | I-23 | II-5 | 50:50 |
| I-II-10 | I-24 | II-1 | 50:50 |
| I-II-11 | I-24 | II-2 | 50:50 |
| I-II-12 | I-24 | II-5 | 50:50 |
| I-II-13 | I-53 | II-1 | 50:50 |
| I-II-14 | I-53 | II-2 | 50:50 |
| I-II-15 | I-53 | II-5 | 50:50 |
| I-II-16 | I-54 | II-1 | 70:30 |
| I-II-17 | I-54 | II-2 | 50:50 |
| I-II-18 | I-54 | II-5 | 50:50 |
| I-II-19 | I-72 | II-1 | 50:50 |
| I-II-20 | I-72 | II-2 | 50:50 |

These polyiminocarbonate resins can easily be synthesized by known processes consisting of reacting a diol compound and a dicyanate compound as described, e.g., in U.S. Pat. No. 3,491,060, British Patent 1,218,447, and Joachim Kohn and Robert Langer, *Biomaterials*, Vol. 7, pp. 176–182 (May, 1986).

For example, a homopolymer having a recurring unit of formula (I), (II) or (III) is prepared by reacting a diol compound represented by formula (Ia), (IIa) or (IIIa) shown below, respectively, with a dicyanate compound represented by formula (Ib), (IIb) or (IIIb) shown below, respectively.

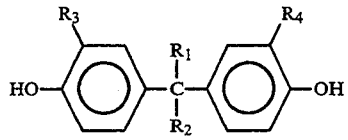
(Ia)

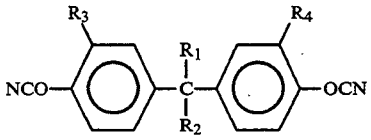
(Ib)

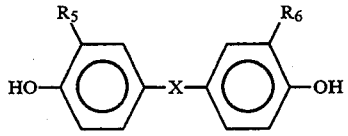
(IIa)

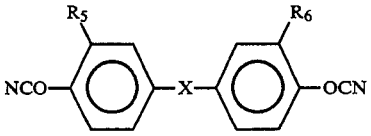
(IIb)

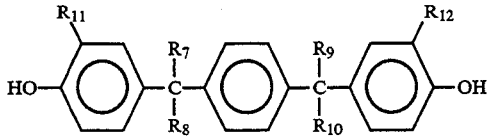
(IIIa)

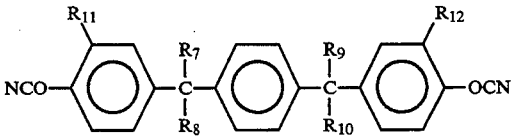
(IIIb)

wherein $R_1$, $R_2$, $R_3$, $R_4$, $R_5$, $R_6$, $R_7$, $R_8$, $R_9$, $R_{10}$, $R_{11}$, and $R_{12}$ are as defined above.

Where the diol compound of formula (Ia), (IIa) or (IIIa) or the dicyanate compound of formula (Ib), (IIb) or (IIIb) is not structurally symmetric, the order of alignment of the polymer component in the resulting polyiminocarbonate resin depends on whether the polymerization reaction occurs in a head-to-head linking system, a head-to-tail linking system or a tail-to-tail linking system and does not always agree with that shown in the above-illustrated structural formula, while the constituent recurring unit agrees with the structure shown in formula (I), (II) or (III).

Similarly, a copolymer having two or more different recurring units can easily be prepared by selecting the corresponding diol compounds and dicyanate compounds. For example, a copolymer comprising recurring units (I) and (III) is obtained by polymerizing diol compounds of formulae (Ia) and (IIIa) with dicyanate compounds of formulae (Ib) and (IIIb) or by block copolymerizing a homopolymer comprising a recurring unit of formula (I) and a homopolymer comprising a recurring unit of formula (III) both having a hydroxyl group at one end thereof and a cyanate group at the other end.

Specific examples of the substituents represented by symbols $R_1$ through $R_{12}$ in formulae (I) to (III), (Ia) to (IIIa), and (Ib) to (IIIb) will be described below.

The alkyl group as represented by $R_1$ to $R_{12}$ may have a straight chain or a branched chain and includes methyl, ethyl, n-propyl, isopropyl, n-butyl, isobutyl, sec-butyl, t-butyl, pentyl, hexyl, heptyl, octyl, nonyl, decyl, undecyl, dodecyl, tridecyl, cetyl, heptadecyl, octadecyl, eicosyl, heneicosyl, and docosyl groups. The alicyclic or cycloalkyl group as represented by $R_1$ to $R_{12}$ includes cyclopentyl, cyclohexyl, cycloheptyl, cyclooctyl, bicyclo[2.2.1]heptyl, and bicyclo[2.2.2]octyl groups. The aryl group as represented by $R_1$ to $R_{12}$ includes phenyl, biphenyl, and naphthyl groups. The aralkyl group as represented by $R_1$, $R_2$, $R_7$, $R_8$, $R_9$, and $R_{10}$ includes benzyl, phenethyl, phenylpropyl, phenylbutyl, phenylpentyl, phenylhexyl, biphenylmethyl, and naphthylmethyl groups, in which the alkyl moiety may be branched and, where the alkyl moiety has 3 or more carbon atoms, the aryl moiety may be bonded to not only the terminal carbon atom but any of the other carbon atoms. The aryl moiety in the aralkyl group may be substituted with one or more substituents, such as the above-mentioned alkyl groups or halogen atoms hereinafter described.

The halogen atom as represented by $R_3$, $R_4$, $R_5$, $R_6$, $R_{11}$ or $R_{12}$ includes fluorine, chlorine, bromine and iodine atoms. The alkoxy group as represented by $R_3$ to $R_6$, $R_{11}$ or $R_{12}$ includes methoxy, ethoxy, n-propoxy, isopropoxy, n-butoxy, isobutoxy, sec-butoxy, t-butoxy, pentyloxy, and hexyloxy groups. The alicyclic group formed by $R_1$ and $R_2$ taken together includes divalent residues of alicyclic compounds, e.g., cyclopentylidene, cyclohexylidene, cycloheptylidene, and cyclooctylidene groups. The lactone group formed by $R_1$ and $R_2$ taken together includes divalent residues of butyrolactone, valerolactone, caprolactone, caprylolactone, caprynolactone, etc.

In particular, an electrophotographic photoreceptor, either single-layered or multi-layered, containing a polyiminocarbonate resin comprising a recurring unit of formula (I) and/or formula (III) wherein at least one of $R_1$, $R_2$, $R_7$, $R_8$, $R_9$, and $R_{10}$ is an aryl group exhibits improved charge transfer and thereby increased sensitivity. Use of a polyiminocarbonate resin comprising a recurring unit of formula (I) and/or (II) and/or (III) wherein $R_3$, $R_4$, $R_5$, $R_6$, $R_{11}$, and $R_{12}$ each have a substituent selected from a halogen atom, an alkyl group, an alkoxy group, a cycloalkyl group, and an aryl group is effective to improve abrasion resistance.

The polyiminocarbonate resin of the present invention usually has a weight average molecular weight of from 30,000 to 600,000. When in using a resin having a single molecular weight peak, the weight average molecular weight is preferably between 60,000 and 300,000. If the weight average molecular weight is less than 30,000, the coating composition has too low a viscosity to obtain a necessary film thickness, causing thickness unevenness when dip-coated. If the weight average molecular weight is greater than 600,000, on the other hand, the coating composition has too high a viscosity, making it very difficult to control the film thickness.

Two or more polyiminocarbonate resins different in molecular weight may be used as a mixture as long as each polyiminocarbonate resin has a weight average molecular weight of from 30,000 to 600,000.

The above-mentioned polyiminocarbonate resins may be used either individually or in combination of two or more thereof. They may also be used in combination with known binder resins as long as the effects of the present invention are not impaired. In the case, the polyiminocarbonate resin is generally contained in the photosensitive layer in an amount of 50% by weight or more, preferably 60% by weight or more, based on the total weight of the binder resins used therein, regardless of whether the photosensitive layer is a single layer type or a laminate type.

A photosensitive layer having a single layer structure comprises a photoconductive material (charge generating material) and a charge transporting material dispersed in the polyiminocarbonate resin according to the present invention.

The charge generating materials which can be used in the present invention include inorganic photoconductive materials, e.g., amorphous selenium, crystalline selenium-tellurium alloys, selenium-arsenic alloys, other selenium compounds and alloys, zinc oxide, and titanium oxide; and organic photoconductive materials, e.g., phthalocyanine compounds, squarylium compounds, anthanthrone compounds, perylene compounds, azo compounds, anthraquinone compounds, pyrene compounds, pyrylium salts, and thiapyrylium salts.

Charge transporting materials which can be used in the present invention include electron-attracting substances, such as quinone compounds (e.g., p-benzoquinone, chloranil, bromanil, and anthraquinone), tetracyanoquinodimethane compounds, fluorenone compounds (e.g., 2,4,7-trinitrofluorenone), xanthone compounds, benzophenone compounds, cyanovinyl compounds, and ethylenic compounds; and electron-donating compounds, such as triphenylamine compounds, arylalkane compounds, aryl-substituted ethylenic compounds, benzidine compounds, butadiene compounds, stilbene compounds, anthracene compounds, hydrazone compounds, and polymers having a residue of these electron-donating compounds in the main or side chain thereof. These charge transporting materials may be used either individually or in combination of two or more thereof.

The charge generating material is used in a single-layered photosensitive layer in an amount of from 0.1 to 20 parts, and preferably from 0.5 to 5 parts, by weight per part by weight of the sum of a charge transporting material and a binder resin. A compounding ratio of a charge transporting material and a binder resin preferably ranges from 60:40 to 30:70 by weight.

Suitable solvents to be used for formation of a single-layered photosensitive layer include aromatic hydrocarbons, e.g., benzene, toluene, xylene, and monochlorobenzene; ketones, e.g., acetone and 2-butanone; halogenated aliphatic hydrocarbons, e.g., methylene chloride, chloroform, and ethylene chloride; and cyclic or acyclic ethers, e.g., tetrahydrofuran and ethyl ether. These organic solvents may be used either individually or in combination of two or more thereof.

A coating composition for a single-layered photosensitive layer can be prepared by uniformly dissolving or dispersing the above-described charge generating material, charge transporting material and binder resin and, if desired, additives in an appropriate solvent. The coating composition is coated by any of known techniques, such as blade coating, wire bar coating, spray coating, dip coating, bead coating, air knife coating, and curtain coating, and dried to form a photosensitive layer having a dry thickness of from 5 to 50 μm, and preferably from 10 to 25 μm.

In the case where a photosensitive layer has a laminate structure, the above-mentioned polyiminocarbonate resin may be used in either of a charge generating layer and a charge transporting layer but is preferably used in the latter layer.

A charge generating layer comprises the above-mentioned charge generating material dispersed in a binder resin.

The binder resin to be used in a charge generating layer includes not only the polyiminocarbonate resin of the present invention but other known binder resins, such as polyvinyl butyral resins, polyvinyl formal resins, partially modified polyvinyl acetal resins, polycarbonate resins, polyester resins, acrylic resins, polyvinyl chloride resins, polystyrene resins, polyvinyl acetate resins, vinyl chloride-vinyl acetate copolymers, silicone resins, phenolic resins, and poly-N-vinylcarbazole resins. These binder resins may be used either individually or in combination of two or more thereof.

Where a combination of the polyiminocarbonate resin according to the present invention and known resins is used in a charge generating layer to obtain desired effects of the present invention, the compounding ratio of the known resins must be controlled so as not to impair the effects of the polyiminocarbonate resin.

Since the polyiminocarbonate resin of the invention has good compatibility with the above-mentioned charge generating material, an electrophotographic photoreceptor whose charge generating layer contains the resin exhibits markedly improved electric characteristics and image quality over a conventional photoreceptor whose charge generating layer contains a known polycarbonate resin.

A suitable mixing ratio of a charge generating material to binder resins is from 5:1 to 1:2 by volume.

Suitable organic solvents to be used for formation of a charge generating layer are chloroform, methylene chloride, toluene, monochlorobenzene, methyl cellosolve, ethyl cellosolve, acetone, methyl ethyl ketone, cyclohexanone, methyl acetate, n-butyl acetate, dioxane, tetrahydrofuran, methanol, ethanol, n-propyl alcohol, n-butanol, and benzyl alcohol. These solvents may be used either individually or in combination of two or more thereof.

A coating composition for a charge generating layer can be prepared by uniformly dissolving or dispersing the above-described charge generating material and a binder resin and, if desired, additives in an appropriate solvent. The coating composition is coated by any of known techniques, such as blade coating, wire bar coating, spray coating, dip coating, bead coating, air knife coating, and curtain coating, and dried to form a charge generating layer having a dry thickness of from 0.01 to 5 μm, and preferably from 0.1 to 2.0 μm.

A charge transporting layer comprises the above-mentioned charge transporting material dispersed in a binder resin, preferably the polyiminocarbonate resin of the present invention.

A mixing ratio of the charge transporting material to the binder resin is from 25:75 to 60:40 by weight. If the proportion of the charge transporting material is less than 25% by weight, the resulting photoreceptor has seriously reduced electric characteristics. If it exceeds 60% by weight, the photoreceptor has extremely reduced resistance to abrasion, peel, and discharge products.

The same solvents and the same coating techniques as used for the single-layered photosensitive layer formation apply to the charge transporting layer. The charge transporting layer usually has a thickness of from 5 to 50 μm, and preferably from 10 to 30 μm.

For the purpose of protecting a photoreceptor from ozone or oxidizing gases generated in a copying machine or heat and light, antioxidants, photostabilizers, thermal stabilizers or like additives may be added to a photoreceptor.

Examples of usable antioxidants include a hindered phenol, a hindered amine, p-phenylenediamine, an arylalkane, hydroquinone, spirocoumarone, spiroindanone, derivatives of these compounds, organic sulfur compounds, and organic phosphorus compounds.

Examples of usable photostabilizers are benzophenone, benzotriazole, dithiocarbamate, tetramethylpiperidine, and derivatives thereof.

As previously stated, it is preferable that at least one of the polyiminocarbonate binder resins of the present invention is incorporated into the uppermost layer of a photosensitive layer. That is, in the case of a single-layered photosensitive layer, the polyiminocarbonate resin is present in the photosensitive layer. In the case of a laminate type photosensitive layer, the resin is preferably incorporated into an upper charge transporting layer while the resin may not be contained in a lower charge generating layer. Where a charge generating layer is an upper layer, the polyiminocarbonate resin may be incorporated into that layer while using ill the lower charge transporting layer other binder resins as enumerated above with respect to the charge generating layer.

If desired, the electrophotographic photoreceptor may have a protective layer on the surface thereof.

The present invention will now be illustrated in greater detail with reference to Examples, but it should be understood that the present invention is not construed as being limited thereto. All the parts are by weight unless otherwise indicated.

EXAMPLE 1

A solution consisting of 10 parts of a zirconium compound (Orgatics ZC540 produced by Matsumoto Seiyaku Co., Ltd.), 1 part of a silane compound (A1110 produced by Nippon Unicar Co., Ltd.), 40 parts of isopropyl alcohol, and 20 parts of butanol was coated on an aluminum substrate by dip coating and dried at 150° C. for 10 minutes to form a 0.15 μm thick subbing layer.

One part of an oxytitanyl phthalocyanine pigment was mixed with 1 part of a polyvinyl butyral resin (S-Lec BM-S produced by Sekisui Chemical Co., Ltd.) and 100 parts of cyclohexanone, and the mixture was dispersed in a sand mill together with glass beads for 1 hour. The resulting coating composition was coated on the subbing layer by dip coating and dried by heating at 100° C. for 10 minutes to form a charge generating layer having a thickness of 0.20 μm.

In 85 parts of monochlorobenzene were dissolved 8 parts of N,N'-diphenyl-N,N'-bis(3-methylphenyl)-[1,1'-biphenyl]-4,4'-diamine as a charge transporting material and 12 parts of a polyiminocarbonate resin comprising a recurring unit of Unit No. I-23, and the resulting coating composition was coated on the charge generating layer by dip coating and dried by heating at 115° C. for 1 hour to form a charge transporting layer having a thickness of 25 μm. The thus formed coating film was observed with the naked eye. Further, the above-prepared coating composition was allowed to stand in the open air for 2 days to observe any change.

The resulting electrophotographic photoreceptor was set on an electrostatic copying paper testing apparatus (Electrostatic Analyzer EPA-8100, manufactured by Kawagushi Denki K.K.). The photoreceptor was charged to −6 kV by corona discharge in an ambient temperature and ambient humidity condition (20° C., 40% RH) and then exposed to monochromatic light at 780 nm emitted from a tungsten lamp, isolated by means of a monochromator, and adjusted to have an energy of 1 μW/cm$^2$ on the surface of the photoreceptor. The initial surface potential $V_0$ (V) and half-decay exposure amount $E_{\frac{1}{2}}$ (erg/cm$^2$) were measured. Then, the photoreceptor was exposed to white light of 10 lux for 1 second, and the residual potential $V_{RP}$ (V) was measured. The results obtained are shown in Table 1 below.

Comparative Example 1

An electrophotographic photoreceptor was prepared in the same manner as in Example 1, except for replacing the polyiminocarbonate resin having Unit No. I-23 with a polycarbonate resin comprising a recurring unit represented by formula (A) shown below and replacing monochlorobenzene as a solvent with dichloromethane. The results of evaluation conducted in the same manner as in Example 1 are shown in Table 1.

(A)

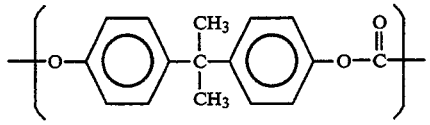

EXAMPLE 2

An electrophotographic photoreceptor was prepared in the same manner as in Example 1, except for replacing the polyiminocarbonate resin having Unit No. I-23 with a polyiminocarbonate resin comprising Unit No. I-14 and replacing monochlorobenzene as a solvent with toluene. The results of evaluation conducted in the same manner as in Example 1 are shown in Table 1.

Comparative Example 2

An electrophotographic photoreceptor was prepared in the same manner as in Example 2, except for replacing the polyiminocarbonate resin having Unit No. I-14 with a polycarbonate resin comprising a recurring unit of formula (B) shown below. The results of evaluation conducted in the same manner as in Example 1 are shown in Table 1.

(B)

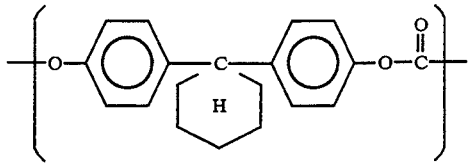

EXAMPLE 3

An electrophotographic photoreceptor was prepared in the same manner as in Example 1, except for replacing the polyiminocarbonate resin having Unit No. I-23 with a polyiminocarbonate resin comprising Unit No. II-2. The resulting photoreceptor was evaluated in the same manner as in Example 1. The results obtained are shown in Table 1.

Comparative Example 3

An electrophotographic photoreceptor was prepared in the same manner as in Example 3, except for replacing the polyiminocarbonate resin having Unit No. II-2 with a polycarbonate resin having a recurring unit represented by formula (C) shown below and replacing monochlorobenzene as a solvent with dichloromethane. The results of evaluations are shown in Table 1.

(C)

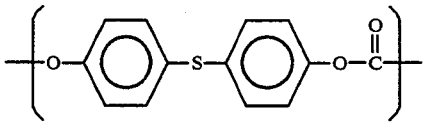

EXAMPLE 4

An electrophotographic photoreceptor was prepared in the same manner as in Example 1, except for replacing the polyiminocarbonate resin having Unit No. I-23 with a copolyiminocarbonate resin I-II-8. The results of evaluation are shown in Table 1.

TABLE 1

| Example No. | Binder Resin | Coated Film Properties | Electric Characteristics $V_0$ (V) | $E_{\frac{1}{2}}$ (erg/cm$^2$) | $V_{RP}$ (V) | Coating Composition Stability (2 days) |
|---|---|---|---|---|---|---|
| Example 1 | polyiminocarbonate (Unit No. I-23) | satisfactory | −811 | 2.4 | −60 | no change |
| Comparative Example 1 | polycarbonate (A) | orange peel, partial precipitation | −820 | 2.6 | −50 | precipitation of solid |
| Example 2 | polyiminocarbonate (Unit No. I-14) | satisfactory | −818 | 2.2 | −52 | no change |
| Comparative Example 2 | polycarbonate (B) | satisfactory | −820 | 2.2 | −51 | gelation |
| Example 3 | polyiminocarbonate (Unit No. II-2) | satisfactory | −826 | 3.0 | −63 | no change |
| Comparative Example 3 | polycarbonate (C) | orange peel, partial precipitation of charge generating material | −830 | 3.7 | −75 | precipitation of solid |
| Example 4 | copolyimino-carbonate (I-II-8) | satisfactory | −815 | 2.7 | −70 | no change |

EXAMPLE 5

A solution consisting of 10 parts of a zirconium compound (Orgatics ZC540), 1 part of a silane compound (A1110), 40 parts of isopropyl alcohol, and 20 parts of butanol was coated on an aluminum drum by dip coating and dried at 150° C. for 10 minutes to foden a 0.15 μm thick subbing layer.

In a mixed solvent of 20 parts of monochlorobenzene and 80 parts of tetrahydrofuran were dissolved 10 parts of N-ethylcarbazole-3-aldehydediphenylhyrazone as a charge transporting material and 10 parts of a polyiminocarbonate resin comprising a recurring unit of Unit No. I-24, and 1 part of oxytitanyl phthalocyanine was added thereto as a charge generating material. The mixture was dispersed in a sand mill together with glass beads for 1 hour. The resulting coating composition was coated on the subbing layer by dip coating and dried by heating at 115° C. for 60 minutes to form a single-layered photosensitive layer having a thickness of 25 μm. The thus formed coating film was observed with the naked eye.

The resulting electrophotographic photoreceptor was mounted on a remodeled machine of a laser beam printer (XP-11, manufactured by Fuji Xerox Co., Ltd.). A running test of 30,000 printing cycles was carried out without feeding paper (i.e., no transfer to paper). The image quality was evaluated for every 3,000 printing cycles. The results obtained are shown in Table 2 below.

EXAMPLE 6

An electrophotographic photoreceptor was prepared in the same manner as in Example 5, except for replacing the polyiminocarbonate resin having Unit No. I-24 with a polyiminocarbonate resin having Unit No. I-15. The results of evaluation are shown in Table 2.

EXAMPLE 7

An electrophotographic photoreceptor was prepared in the same manner as in Example 5, except for replacing the polyiminocarbonate resin having Unit No. I-24 with a polyiminocarbonate resin having Unit No. II-5. The results of evaluation are shown in Table 2.

EXAMPLE 8

An electrophotographic photoreceptor was prepared in the same manner as in Example 5, except for replacing the polyiminocarbonate resin having Unit No. I-24 with a copolyiminocarbonate resin I-II-15. The results of evaluation are shown in Table 2.

Comparative Example 4

An electrophotographic photoreceptor was prepared in the same manner as in Example 5, except for replacing the polyiminocarbonate resin having Unit No. I-24 with a polycarbonate resin having a recurring unit represented by formula (D) shown below. The results of evaluation are shown in Table 2.

(D)

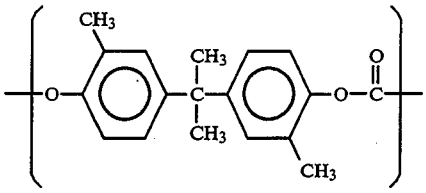

Comparative Example 5

An electrophotographic photoreceptor was prepared in the same manner as in Example 5, except for replacing the polyiminocarbonate resin having Unit No. I-24 with a polycarbonate resin having a recurring unit represented by formula (E) shown below. The results of evaluation are shown in Table 2.

(E)

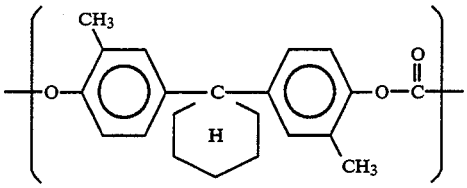

TABLE 2

| Example No. | Binder Resin | Coated Film Properties | Image Quality After 30,000 Printing Cycles |
|---|---|---|---|
| Example 5 | polyiminocarbonate (Unit No. I-24) | satisfactory | no problem |
| Example 6 | polyiminocarbonate (Unit No. I-15) | satisfactory | no problem |
| Example 7 | polyiminocarbonate (Unit No. II-5) | satisfactory | no problem |
| Example 8 | copolyiminocarbonate (I-II-15) | satisfactory | no problem |
| Comparative Example 4 | polycarbonate (D) | the pigment agglomerated due to poor dispersibility | overall fog developed in the initial stage, getting worse on the 3,000th cycles (the test was stopped) |
| Comparative Example 5 | polycarbonate (E) | the pigment agglomerated due to poor dispersibility | overall fog developed in the initial stage, getting worse on the 3,000th cycles (the test was stopped) |

EXAMPLE 9

A solution consisting of 10 parts of a zirconium compound (Orgatics ZC540), 1 part of a silane compound (A1110), 40 parts of isopropyl alcohol, and 20 parts of butanol was coated on an aluminum substrate by dip coating and dried at 150° C. for 10 minutes to form a 0.10 μm thick subbing layer.

One part of an oxytitanyl phthalocyanine pigment was mixed with 1 part of a polyvinyl butyral resin (S-Lec BM-S) and 100 parts of cyclohexanone, and the mixture was dispersed in a sand mill together with glass beads for 1 hour. The resulting coating composition was coated on the subbing layer by dip coating and dried by heating at 100° C. for 10 minutes to form a charge generating layer having a thickness of 0.20 μm.

In 85 parts of monochlorobenzene were dissolved 8 parts of N,N'-diphenyl-N,N'-(m-tolyl)benzidine as a charge transporting material and 12 parts of a polyiminocarbonate resin comprising a recurring unit of Unit No. III-4 (weight average molecular weight (Mw): 118,000), and the resulting coating composition was coated on the charge generating layer by dip coating and dried by heating at 120° C. for 1 hour to form a charge transporting layer having a thickness of 25 μm.

EXAMPLE 10

An electrophotographic photoreceptor was prepared in the same manner as in Example 9, except for using a copolyiminocarbonate resin comprising Unit Nos. III-5 and I-53 at a molar ratio of 50:50 (Mw: 98,000) as a binder resin for the charge transporting layer.

EXAMPLE 11

An electrophotographic photoreceptor was prepared in the same manner as in Example 9, except for using a copolyiminocarbonate resin comprising Unit Nos. III-4 and II-1 at a molar ratio of 50:50 (Mw: 82,000) as a binder resin for the charge transporting layer.

EXAMPLE 12

An electrophotographic photoreceptor was prepared in the same manner as in Example 9, except for using a copolyiminocarbonate resin comprising Unit Nos. III-8 and II-5 at a molar ratio of 50:50 (Mw: 133,000) as a binder resin for the charge transporting layer.

EXAMPLE 13

An electrophotographic photoreceptor was prepared in the same manner as in Example 9, except for using a mixture of 6 parts of a polyiminocarbonate resin having Unit No. III-4 (Mw: 118,000) and 6 parts of a polyiminocarbonate resin having Unit No. III-8 (Mw: 87,000) as a binder resin for the charge transporting layer.

EXAMPLE 14

An electrophotographic photoreceptor was prepared in the same manner as in Example 9, except for using a mixture of 6 parts of a polyiminocarbonate resin having Unit No. III-17 (Mw: 73,000) and 6 parts of a polyiminocarbonate resin having Unit No. I-14 (Mw: 122,000) as a binder resin for the charge transporting layer.

EXAMPLE 15

An electrophotographic photoreceptor was prepared in the same manner as in Example 9, except for using a mixture of 6 parts of a polyiminocarbonate resin having Unit No. III-17 (Mw: 87,000) and 6 parts of a polyiminocarbonate resin having Unit No. II-2 (Mw: 104,000) as a binder resin for the charge transporting layer.

Comparative Example 6

An electrophotographic photoreceptor was prepared in the same manner as in Example 9, except for replacing the polyiminocarbonate resin used in the charge transporting layer with a polycarbonate resin comprising a recurring unit of formula (A) and replacing monochlorobenzene as a coating solvent with methylene chloride.

Comparative Example 7

A coating composition for a charge transporting layer was prepared in the same manner as in Example 9, except for replacing the polyiminocarbonate resin with a mixture of 6 parts of a polycarbonate resin having a recurring unit of formula (A) and 6 parts of a polycarbonate resin having a recurring unit of formula (F) shown below. However, the polycarbonate resin (A) was not dissolved.

(F)

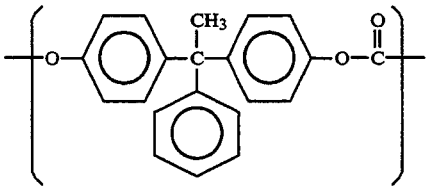

Comparative Example 8

A coating composition for a charge transporting layer was prepared in the same manner as in Example 9, except for replacing the polyiminocarbonate resin with a mixture of 6 parts of a polycarbonate resin having a recurring unit of formula (B) and 6 parts of a polycarbonate resin having a recurring unit of formula (G) shown below. However, the coating composition was semi-transparent with white turbidity revealing incompatibility between the polycarbonate resins (B) and (G).

(G)

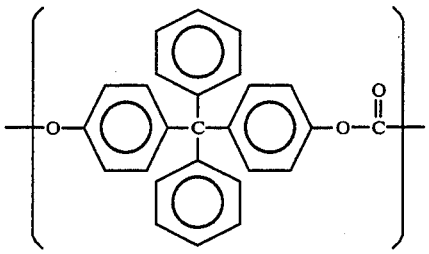

Comparative Example 9

A coating composition for a charge transporting layer was prepared in the same manner as in Example 9, except for replacing the polyiminocarbonate resin with a polycarbonate resin having a recurring unit of formula (H) shown below. However, the polycarbonate (H) did not completely dissolve only to provide a semi-transparent coating composition.

(H)

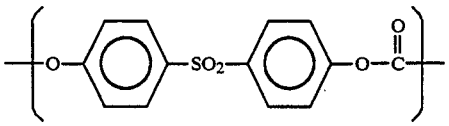

Comparative Example 10

A coating composition for a charge transporting layer was prepared in the same manner as in Example 9, except for replacing the polyiminocarbonate resin with a mixture of 6 parts of a polycarbonate resin having a recurring unit of formula (C) and 6 parts of a polycarbonate resin having a recurring unit of formula (G). However, the resulting coating composition was semi-transparent, revealing incompatibility between the polycarbonate resins (C) and (G).

Each of the electrophotographic photoreceptors obtained in Examples 9 to 15 and Comparative Example 6 was evaluated in the same manner as in Example 1. The results obtained are shown in Table 3 below.

The coating film on the surface of each photoreceptor was evaluated with the naked eye. Further, each coating composition for a charge transporting layer was allowed to stand in an open air at room temperature for 2 days to observe any change. These results are also shown in the Table.

TABLE 3

| Example No. | Binder Resin | Coated Film Properties | Coating Composition Stability | $V_0$ (V) | $E_{\frac{1}{2}}$ (erg/cm$^2$) | $V_{RP}$ (V) |
|---|---|---|---|---|---|---|
| Example 9 | polyiminocarbonate (Unit No. III-4) | satisfactory | no change | −807 | 2.3 | −50 |
| Example 10 | copolyiminocarbonate (Unit Nos. III-5/ I-53) | satisfactory | no change | −805 | 1.9 | −40 |
| Example 11 | copolyiminocarbonate (Unit Nos. III-4/ II-1) | satisfactory | no change | −807 | 2.4 | −55 |
| Example 12 | copolyiminocarbonate (Unit Nos. III-8/ II-5) | satisfactory | no change | −812 | 2.2 | −47 |
| Example 13 | mixed polyimino-carbonate (Unit Nos. III-4/ III-8) | satisfactory | no change | −810 | 2.0 | −41 |
| Example 14 | mixed polyimino- | satisfactory | no change | −810 | 2.0 | −38 |

TABLE 3-continued

| Example No. | Binder Resin | Coated Film Properties | Coating Composition Stability | $V_0$ (V) | $E_{\frac{1}{2}}$ (erg/cm$^2$) | $V_{RP}$ (V) |
|---|---|---|---|---|---|---|
| | carbonate (Unit Nos. III-17/ I-14) | | | | | |
| Example 15 | mixed polyimino-carbonate (Unit Nos. III-17/ II-2) | satisfactory | no change | −816 | 2.9 | −53 |
| Compara. Example 6 | polycarbonate (A) | orange peel, partial precipitation | precipitation of solid | −810 | 2.5 | −45 |
| Compara. Example 7 | mixed polycarbonate (A)/(F) | impractical due to insolubility of the binder resin | — | — | — | — |
| Compara. Example 8 | mixed polycarbonate (B)/(G) | impractical due to incompatibility of the binder resins | — | — | — | — |
| Compara. Example 9 | polycarbonate (H) | impractical due to incomplete dissolution in the solvent and semi-transparent | — | — | — | — |
| Compara. Example 10 | mixed polycarbonate (C)/(G) | impractical due to incompatibility of the binder resins | — | — | — | — |

EXAMPLE 16

A solution consisting of 10 parts of a zirconium compound (Orgatics ZC540), 1 part of a silane compound (A1110), 40 parts of isopropyl alcohol, and 20 parts of butanol was coated on an aluminum drum by dip coating and dried at 150° C. for 10 minutes to form a 0.15 μm thick subbing layer.

In a mixed solvent of 20 parts of monochlorobenzene and 80 parts of tetrahydrofuran were dissolved 10 parts of N-ethylcarbazole-3-aldehydediphenylhyrazone as a charge transporting material and 10 parts of a polyiminocarbonate resin comprising a recurring unit of Unit No. III-9 (Mw: 81,000), and 1 part of oxytitanyl phthalocyanine was added thereto as a charge generating material. The mixture was dispersed in a sand mill together with glass beads for 1 hour. The resulting coating composition was coated on the subbing layer by dip coating and dried by heating at 115° C. for 60 minutes to form a single-layered photosensitive layer having a thickness of 25 μm.

EXAMPLE 17

An electrophotographic photoreceptor was prepared in the same manner as in Example 16, except for replacing the polyiminocarbonate resin comprising Unit No. III-9 with a polyiminocarbonate resin comprising Unit No. III-18 (Mw: 119,000).

EXAMPLE 18

An electrophotographic photoreceptor was prepared in the same manner as in Example 16, except for using a copolyiminocarbonate resin comprising Unit Nos. III-5 and I-53 at a molar ratio of 50:50 (Mw: 98,000) as a binder resin.

EXAMPLE 19

An electrophotographic photoreceptor was prepared in the same manner as in Example 16, except for using a copolyiminocarbonate resin comprising Unit Nos. III-5 and II-1 at a molar ratio of 50:50 (Mw: 143,000) as a binder resin.

EXAMPLE 20

An electrophotographic photoreceptor was prepared in the same manner as in Example 16, except for using a mixed binder resin comprising 5 parts of a polyiminocarbonate resin having Unit No. III-9 (Mw: 81,000) and 5 parts of a polyiminocarbonate resin having Unit No. I-24 (Mw: 131,000).

EXAMPLE 21

An electrophotographic photoreceptor was prepared in the same manner as in Example 16, except for using a mixed binder resin comprising 5 parts of a polyiminocarbonate resin having Unit No. III-9 (Mw: 81,000) and 5 parts of a polyiminocarbonate resin having Unit No. II-2 (Mw: 104,000).

Comparative Example 11

An electrophotographic photoreceptor was prepared in the same manner as in Example 16, except for replacing the polyiminocarbonate binder resin with a polycarbonate resin comprising a recurring unit of formula (F).

Comparative Example 12

An electrophotographic photoreceptor was prepared in the same manner as in Example 16, except for replacing the polyiminocarbonate binder resin with a polycarbonate resin comprising a recurring unit of formula (G).

Comparative Example 13

An electrophotographic photoreceptor was prepared in the same manner as in Example 16, except for replacing the polyiminocarbonate resin with a polycarbonate resin comprising a recurring unit of formula (I) shown below.

(I)

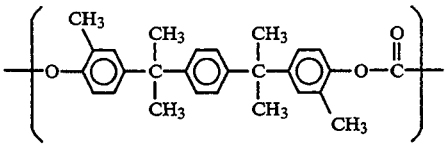

Comparative Example 14

An electrophotographic photoreceptor was prepared in the same manner as in Example 16, except for replacing the polyiminocarbonate binder resin with a copolycarbonate resin comprising recurring units of formulae (D) and (F) at a molar ratio of 50:50.

Comparative Example 15

An electrophotographic photoreceptor was prepared in the same manner as in Example 16, except for replacing the polyiminocarbonate binder resin with a mixture of 5 parts of a polycarbonate resin having a recurring unit of formula (H) and 5 parts of a polycarbonate resin having a recurring unit of formula (I) and replacing the mixed solvent of monochlorobenzene and tetrahydrofuran as a solvent with methylene chloride.

Each of the electrophotographic photoreceptors obtained in Examples 16 to 21 and Comparative Examples 11 to 15 was mounted on a remodeled machine of a laser beam printer (XP-11). A running test of 30,000 printing cycles was carried out without feeding paper (i.e., no transfer to paper). The image quality was evaluated for every 3,000 printing cycles. Further, the surface conditions of the coated film was observed with the naked eye. The results obtained are shown in Table 4 below.

TABLE 4

| Example No. | Binder Resin | Coating Properties | Image Quality After 30,000 Copying Cycles |
|---|---|---|---|
| Example 16 | polyiminocarbonate (Unit No. III-9) | satisfactory | no problem |
| Example 17 | polyiminocarbonate (Unit No. III-18) | satisfactory | no problem |
| Example 18 | copolyiminocarbonate (Unit Nos. III-5/ I-53) | satisfactory | no problem |
| Example 19 | copolyiminocarbonate (Unit Nos. III-5/ II-1) | satisfactory | no problem |
| Example 20 | mixed polyimino-carbonate (III-9/ I-24) | satisfactory | no problem |
| Example 21 | mixed polyimino-carbonate (III-9/II-2) | satisfactory | no problem |
| Comparative Example 11 | polycarbonate (F) | the pigment agglomerated due to poor dispersibility | overall fog developed in the initial stage, getting worse on the 3,000th cycle (the test was stopped) |
| Comparative Example 12 | polycarbonate (G) | the pigment agglomerated due to poor dispersibility | overall fog developed in the initial stage, getting worse on the 3,000th cycle (the test was stopped) |
| Comparative Example 13 | polycarbonate (I) | the pigment agglomerated due to poor dispersibility | overall fog developed in the initial stage, getting worse on the 3,000th cycle (the test was stopped) |
| Comparative Example 14 | copolycarbonate (D)/(F) | the pigment agglomerated due to poor dispersibility | overall fog developed in the initial stage, getting worse on the 3,000th cycle (the test was stopped) |
| Comparative Example 15 | mixed polycarbonate (H)/(I) | the pigment agglomerated due to poor dispersibility, the resins were incompatible | unable of evaluation |

The binder resin containing the polyiminocarbonate resin used in the present invention exhibits satisfactory solubility in an organic solvent to provide a coating composition having excellent stability with time without undergoing gelation. Further, the polyiminocarbonate resin has high compatibility with a charge transporting material and a charge generating material to provide a uniform coating film. Therefore, the electrophotographic photoreceptor according to the present invention can be produced with satisfactory productivity. Further, the photoreceptor has satisfactory electrophotographic characteristics and excellent stability against repeated use and therefore provides copy images of high quality even when used repeatedly in a printer for an extended period of time.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having formed thereon a photosensitive layer, wherein said photosensitive layer contains, as a binder resin, a polyiminocarbonate resin comprising at least one of a recurring unit represented by formula (I):

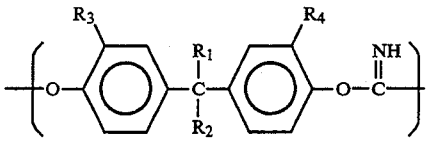

(I)

wherein $R_1$ and $R_2$ each represent a hydrogen atom, an alkyl group, an aryl group, an aralkyl group or an alicyclic group, or $R_1$ and $R_2$ are taken together to form a carbonaceous ring or a lactone ring; and $R_3$ and $R_4$ each represent a hydrogen atom, a halogen atom, an alkyl group, an alkoxy group, an aryl group or a cycloalkyl group, a recurring unit represented by formula (II):

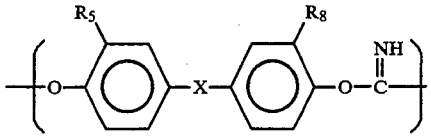

(II)

wherein X represents —S—, —O—, —$SO_2$— or —CO—; and $R_5$ and $R_6$ each represent a hydrogen atom, a halogen atom, an alkyl group, an aryl group, an alkoxy group or a cycloalkyl group, and a recurring unit represented by formula (III):

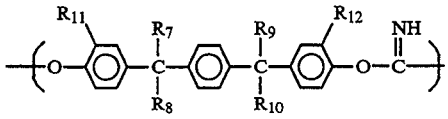

(III)

wherein $R_7$, $R_8$, $R_9$, and $R_{10}$ each represent a hydrogen atom, an alkyl group, a cycloalkyl group, an aryl group or an aralkyl group; and $R_{11}$ and $R_{12}$ each represent a hydrogen atom, a halogen atom, an alkyl group, an alkoxy group, a cycloalkyl group or an aryl group.

2. An electrophotographic photoreceptor as claimed in claim 1, wherein said polyiminocarbonate resin comprises one or two recurring units selected from the recurring units represented by formulae (I), (II), and (III).

3. An electrophotographic photoreceptor as claimed in claim 2, wherein said polyiminocarbonate resin is a homopolymer comprising the recurring unit represented by formula (I), a homopolymer comprising the recurring unit represented by formula (II) or a copolymer comprising the recurring unit represented by formula (I) and the recurring unit represented by formula (II).

4. An electrophotographic photoreceptor as claimed in claim 2, wherein said polyiminocarbonate resin is a homopolymer comprising the recurring unit represented by formula (III), a copolymer comprising the recurring unit represented by formula (III) and the recurring unit represented by formula (I) or a copolymer comprising the recurring unit represented by formula (II) and the recurring unit represented by formula (III).

5. An electrophotographic photoreceptor as claimed in claim 1, wherein said polyiminocarbonate resin is present in an uppermost layer of said photosensitive layer.

6. An electrophotographic photoreceptor as claimed in claim 1, wherein said photosensitive layer has a laminate structure composed of a charge generating layer and a charge transporting layer, said charge generating layer containing said polyiminocarbonate resin.

7. An electrophotographic photoreceptor as claimed in claim 5, wherein said photosensitive layer has a laminate structure composed of a charge generating layer and a charge transporting layer, said charge transporting layer containing said polyiminocarbonate resin and constituting the uppermost layer of said laminate structure.

8. An electrophotographic photoreceptor as claimed in claim 1, wherein said photosensitive layer has a single layer structure.

* * * * *